US006548163B1

(12) United States Patent
Hills

(10) Patent No.: US 6,548,163 B1
(45) **Date of Patent: *Apr. 15, 2003**

(54) SEALING STRIP AND METHOD OF SEALING

(75) Inventor: Robin William Hills, Bucks (GB)

(73) Assignee: Speedarrive Projects Ltd. (GB)

( * ) Notice: Subject to any disclaimer, the term of this patent is extended or adjusted under 35 U.S.C. 154(b) by 0 days.

This patent is subject to a terminal disclaimer.

(21) Appl. No.: 09/519,203

(22) Filed: Mar. 6, 2000

Related U.S. Application Data

(63) Continuation of application No. 08/693,126, filed as application No. PCT/GB95/00304 on Feb. 14, 1995, now Pat. No. 6,086,709.

(30) Foreign Application Priority Data

Feb. 14, 1994 (GB) ..... 9402812

(51) Int. Cl.[7] ..... B05B 15/04; B05C 21/00

(52) U.S. Cl. ..... 428/343; 428/41.7; 156/293; 427/282; 427/421

(58) Field of Search ..... 156/247, 280, 156/293, 94; 427/282, 421; 428/41.7, 41.8

(56) References Cited

U.S. PATENT DOCUMENTS

| | | | | |
|---|---|---|---|---|
| RE19,128 E | * | 4/1934 | Drew | |
| 3,743,150 A | | 7/1973 | Eckart, Jr. | |
| 4,389,270 A | | 6/1983 | McClintock | |
| 5,128,176 A | | 7/1992 | Schmidt | |
| 5,260,097 A | | 11/1993 | Silvestre | |
| 5,640,827 A | * | 6/1997 | Van Someren et al. | 52/750 |

FOREIGN PATENT DOCUMENTS

| | | |
|---|---|---|
| DE | 4106960 | 9/1992 |
| EP | 9015668 | 12/1990 |
| GB | 2223425 | 4/1990 |
| WO | WO9015668 | 12/1990 |

OTHER PUBLICATIONS

International Search Report for PCT Application No. PCT/GB95/00304, dated May 17, 1995 (2 pages).

* cited by examiner

*Primary Examiner*—Sam Chuan Yao
(74) *Attorney, Agent, or Firm*—Webb Ziesenheim Logsdon Orkin & Hanson, P.C.

(57) ABSTRACT

A sealing strip comprising an elongate sealing portion formed of resiliently compressible material such as foam and an elongate attachment portion extending laterally from the sealing portion. The attachment portion is provided with adhesive to affix it to the rear side of a first body panel so that the sealing portion is located in a gap between the panel and an adjacent component so as to seal or mask the gap therebetween. The sealing portion and attachment portion are preferably integrally formed by an extrusion process. The sealing strip has particular application to the sealing of the "B" post gap of a motor vehicle.

8 Claims, 3 Drawing Sheets

SEALING STRIP AND METHOD OF SEALING

This application is a continuation of U.S. patent application Ser. No. 08/693,126, filed Aug. 12, 1996, now U.S. Pat. No. 6,086,709, which was the national stage of International Application PCT/GB95/00304, filed Feb. 14, 1995.

FIELD OF THE INVENTION

This invention relates to sealing strips and to methods of sealing a gap using such strips. A particular application of the invention is to the sealing of gaps around body panels of a vehicle which is being sprayed to prevent overspray from entering the sealed gaps.

BACKGROUND ART

U.S. Pat. Nos. 5,128,176 and 5,260,097 describe sealing strips which can be used for sealing or masking gaps between vehicle bodies and the edges of vehicle body panels, such as doors, bonnets or boot lids. Among the sealing strips described in these patents are sealing strips that comprise a length of polymeric foam having a circular or oval cross section and a layer of pressure sensitive adhesive along at least one side surface of the length of foam that can be used to releasably adhere the sealing strip to a vehicle body or body panel in a position along and extending across a gap between adjacent body panels.

The sealing strips described in these patents are, however, difficult to affix accurately along some of such gaps and are only capable of providing an effective seal along certain of such gaps on vehicle bodies.

WO-A-90/15668 discloses a masking device and, in particular, one with a triangular form of cross-section for use in masking a B-post gap of a motor vehicle body. The device is secured to a fixed panel of the body by means of an adhesive tape attached to the base surface thereof so that the device is deformed as a door is closed thereon in order to seal the gap between the fixed panel and the door.

DISCLOSURE OF THE INVENTION

The present invention aims to provide sealing strips which can be used for sealing caps between vehicle bodies and the edges of vehicle body panels, such as doors, bonnets or boot lids, and which have novel shapes and constructions that make them easier to apply along certain of such gaps, and which make them able to easily provide seals across certain of such gaps that cannot easily be sealed using the sealing steps described in the prior art referred to above.

According to a first aspect of the invention, there is provided a sealing strip in the form of an elongate sealing portion formed of resiliently compressible material and an elongate attachment portion extending laterally from the sealing portion, the sealing portion having a cross-section with a convex surface along a first side thereof with an adhesive surface thereon and/or on the opposite side thereof and the attachment portion having an adhesive surface facing in substantially the same direction as said convex surface of the sealing portion.

According to a second aspect of the invention, there is provided a sealing strip in the form of an elongate sealing portion formed of resiliently compressible material and an elongate attachment portion extending laterally from the sealing portion, the sealing portion having a cross-section with a convex surface along a first side thereof and the attachment portion having an adhesive surface facing in substantially the same direction as said convex surface of the sealing portion, the attachment portion being sufficiently longitudinally bendable adjacent said sealing portion to enable the attachment portion to be bent so that a surface thereof opposite said adhesive surface lies against a surface of said sealing portion opposite said convex surface thereof.

According to another aspect of the invention, there is provided a sealing strip comprising an elongate sealing portion formed of resiliently compressible material and an elongate attachment portion extending in a first direction laterally from the sealing portion with an adhesive surface being provided on at least part of the attachment portion, the sealing portion having a greater thickness in a direction substantially perpendicular to the said first direction than the attachment portion and so as to provide a longitudinal hinge between the sealing portion and the attachment portion.

According to further aspects of the invention, there are provided methods of sealing a gap and masking a panel using a sealing strip as claimed herein.

Other, preferred and optional features of the invention will be apparent from the following description and from the subsidiary claims of the specification.

It should be noted that terms such as "upper" and "lower" used in the following description refer only to directions and the accompanying drawings and are not to be interpreted as restricting the invention to any particular orientation.

BRIEF DESCRIPTION OF DRAWINGS

The invention will now be further described, merely by way of example, with reference to the accompanying drawings, in which.

BEST MODE OF CARRYING OUT THE INVENTION

Figure 1:
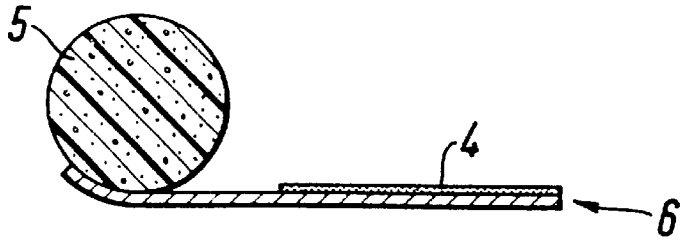
FIGS. 1, 2 and 3 are cross-sectional views of three forms of sealing strip according to the present invention.

FIG. 1 shows a cross-section of a first embodiment of a sealing strip according to the invention. This comprises an elongate sealing portion 5 formed of resilient, compressible, bendable material such as foam with an elongate laterally extending attachment portion in the form of an adhesive strip 6 attached thereto. The sealing portion 5 has a substantially circular or oval cross-section as shown so that it has a convex surface along a first side thereof facing in a first direction (upwards as shown in FIG. 1). The adhesive strip 6 has a layer 4 of pressure sensitive adhesive applied thereto so as to present an adhesive surface facing in the same direction, ie upwards in FIG. 1. A removable protective liner (not shown) may be provided to cover the adhesive layer when not in use if required.

Figure 7A:
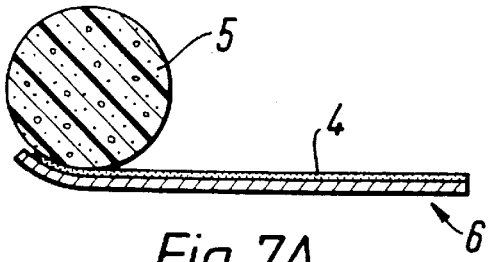
FIGS. 7(A) to 7(F) are cross-sectional side views of further embodiments of a sealing strip according to the present invention.

The elongate sealing portion 5 may be formed of a polymeric foam as used in conventional sealing strips. The adhesive strip 6 may be any suitable form of adhesive tape, whether or paper or plastics, with a layer of adhesive 4 applied to one surface thereof. The strip 6 may be affixed to the sealing portion 5 by means of an adhesive band (not shown) provided on the sealing portion 5, or by means of the layer of adhesive 4 (as shown in FIG. 7(A)), or both.

Figure 2:
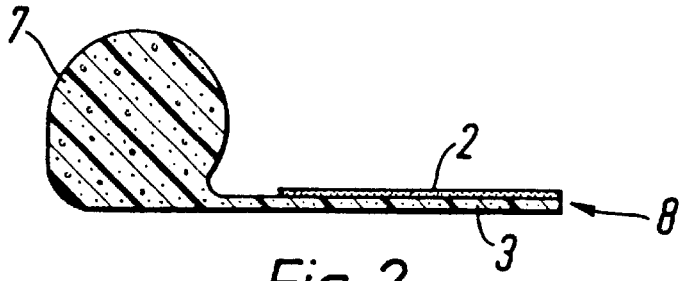

FIG. 2 shows a cross-section of a second embodiment of a sealing strip according to the invention. This comprises an elongate sealing portion 7 with a laterally extending attachment portion in the form of an adhesive strip 8 integrally formed therewith. The sealing portion 7 and adhesive strip 8 are integrally formed of a resilient compressible material such as foam and may, for example, be produced by an extrusion process. The sealing portion 7 is of generally circular or oval shape so that is presents a convex face in a first direction (upwards as shown in FIG. 2). The adhesive strip 8 comprises a thin strip 3 of foam extending laterally from the sealing portion 7 with a layer of adhesive 2 applied to one surface thereof facing in the same direction, ie upwards in FIG. 2.

Figure 3:
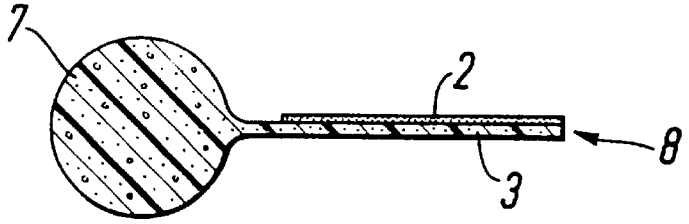

FIG. 2 illustrates the adhesive strip 8 extending substantially tangentially from the sealing portion 7. In another arrangement, the adhesive strip 8 may extend substantially radially from the sealing portion 7 as shown in FIG. 3. It will be seen that the adhesive strip 8 has a substantially uniform thickness in a direction normal to the adhesive surface thereof and that the sealing portion 7 has a larger major thickness in the same direction compared to the adhesive strip 8.

Figure 7E:
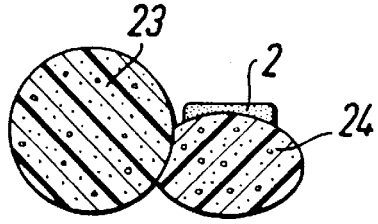
Figure 7B:
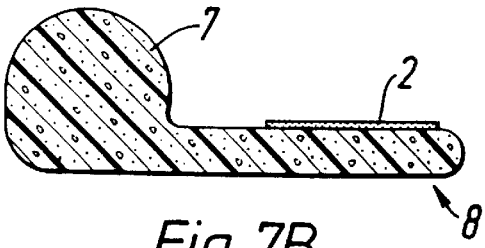
Figure 7F:
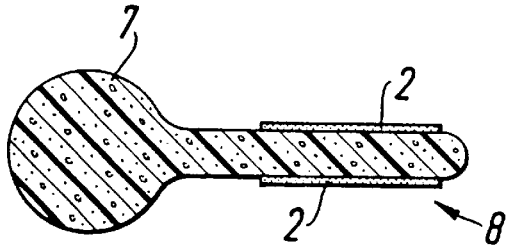
Figure 7C:
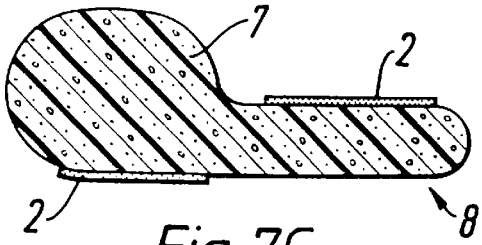
Figure 7D:
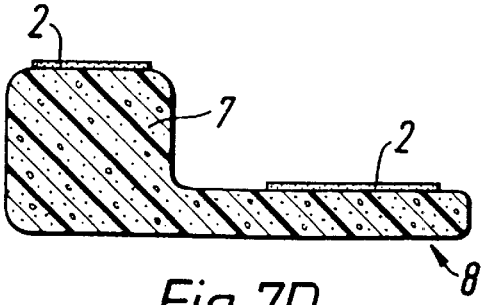

FIGS. 7(B), 7(C) and 7(D) show further embodiments of a sealing strip according to the invention. The embodiment shown in FIG. 7(B) is similar to that shown in FIG. 2 with the sealing portion and attachment portion 8 formed integrally with each other but in this case the attachment portion has a more substantial thickness in a direction normal to the adhesive surface 2. However, it should be noted that, as in the embodiments shown in FIGS. 1 to 3, the sealing portion 7 still has a thickness greater than that of the attachment portion 8 (for reasons discussed further below).

FIGS. 7(C) and 7(D) illustrate further embodiments of the sealing strip. In FIG. 7(C), the sealing portion 7 has a more oval rather than circular cross-section. Also, a layer of adhesive 2 is provided on the lower surface of the sealing portion 3. In FIG. 7(D), both the sealing portion 7 and then attachment portion 8 are more rectangular in cross-section. Also, a layer of adhesive 2 is provided on the upper surface of the sealing portion 7.

FIG. 7(E) shows yet another embodiment of a sealing strip according to the invention. This comprises a sealing portion 23 and an attachment portion 24 which are formed separately and then joined together side by side. Both the sealing portion 23 and the attachment portion 24 have a substantially circular or oval cross-section but the sealing portion has a greater thickness (in the upward direction as shown in the Figures) than the attachment portion 24. The two portions are secured together by adhesive (not shown) or by any other suitable means. The two portions of this form of sealing strip may be co-extruded either with a cross-section as shown or as separate portions which bond together as they emerge from the extrusion die. A layer of adhesive 2 is provided on the attachment portion 24 as in other embodiments.

FIG. 7(F) shows an embodiment similar to that of FIG. 3 but with an attachment portion 8 of more substantial thickness. A layer of adhesive 2 is also provided on both sides of the attachment portion 8 so the sealing strip is symmetrical and can be used either way round.

The attachment portion 8 is preferably bendable longitudinally adjacent to the sealing portion 7 so that the sealing portion 7 and attachment portion 8 can be Folded back to back as will be described further below in relation to FIG. 6.

Figure 4:
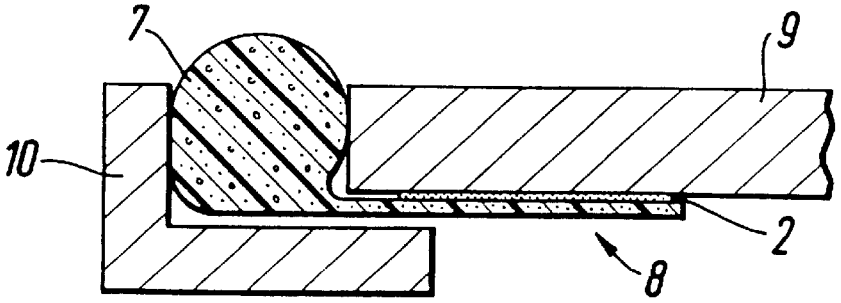
FIG. 4 is a cross-sectional view of a sealing strip as shown in FIG. 2 installed to seal the gap between a vehicle body panel and the adjacent bodywork.

FIG. 4 illustrates the use of the sealing strip of FIG. 2 to seal the gap between a vehicle body panel 9, such as a bonnet, and the surrounding bodywork 10. In this case, the bonnet is first moved to its open position, the sealing strip is then attached to the rear face of the bonnet 9 by means of the adhesive strip 8 so that the sealing portion 7 lies adjacent to the edge of the bonnet 9. When the bonnet 9 is closed, the sealing portion 7 fits or is compressed between the edge of the bonnet 9 and the surrounding bodywork 10 so as to seal the gap therebetween as shown in FIG. 4.

In the application illustrated in FIG. 4, the sealing strip is affixed to the rear edge of the panel which is to be sprayed rather than, as with the prior art, to the edge of the aperture in which the panel fits. In some cases one form of attachment may be more appropriate than the other.

Figure 5:
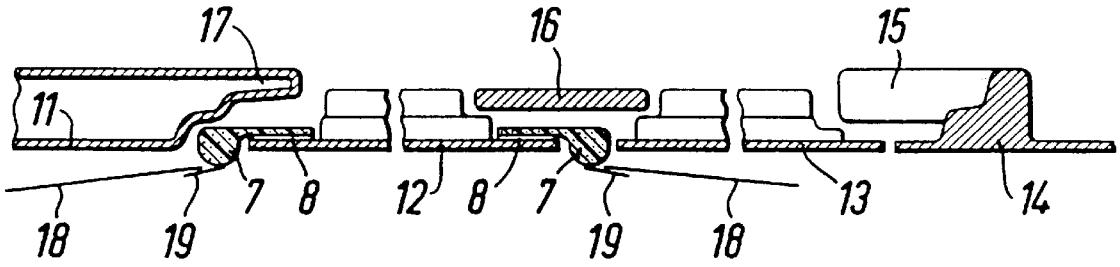
FIG. 5 is a cross-sectional view from above of sealing strips according to the present invention installed to seal the "B" post gap and "C" post gap at the front and rear edges of a vehicle rear door.

FIG. 5 illustrates an application of the sealing strip where known forms of sealing strip cannot easily be used. FIG. 4 is a schematic plan view of the side of a motor vehicle showing a rear wing 11, a rear door 12, a front door 13 and a front wing 14. Between these panels are the "A" post 15, "B" post 16 and "C" post 17. When it is desired to spray, say the rear door 12, it is necessary to seal the gap between the "B" post 16 and the front edge of the rear door 12 and the rear edge of the front door 13, which is known as the "B" post gap, and also the gap between the "C" post 17, the front edge of the rear wing 11 and the rear edge of the rear door 12, which is known as the "C" post gap. With a conventional sealing strip, it is necessary to try to affix the strip around the edges of the aperture in which the rear door 12 fits so that, when the rear door 12 is closed, the sealing strip is trapped between the door 12 and the adjacent panels. However, this is very difficult to achieve in gaps such as as the "B" post gap due to the shape and depth of the gap. It a conventional sealing strip is, for example, affixed to the "B" post 16, it simply lies within the "B" post gap and does not seal the gap between the front edge of the rear door 12 and the rear edge of the front door 13.

With a sealing strip such as that shown in FIG. 2, the rear door 12 is first opened and the strip can then be attached by means of the adhesive strip 8 attached thereto around the edge of the inner surface of the rear door 2. In many cases, it will also be necessary to open the front door 13 to provide access to the front edge of the rear door 12. The sealing strip is attached so that the sealing member 7 thereof projects beyond the edges of the rear door 12 so, when the door 12 is closed again, the sealing portion 7 is positioned within and seals across the "B" post and "C" post gaps as shown in FIG. 5 and so sealing the gap between the front edge of the rear door 12 and the rear edge of the front door 13. If adjacent panels, such as the rear wing 11 and front door 13 need to be masked this can be carried out in the conventional manner by affixing masking paper 18 to the projecting parts of the sealing member 7 by masking tape 19 as shown in the Figure.

A sealing strip such as that shown in FIG. 2 can be used to seal other such gaps in a similar manner, eg by affixing to the rear side of the rear edge of the rear door 12 to seal the "C" post gap and, in some cases by affixing to the rear side of the rear edge of the front wing 14 to seal the "A" post gap.

Figure 6A:
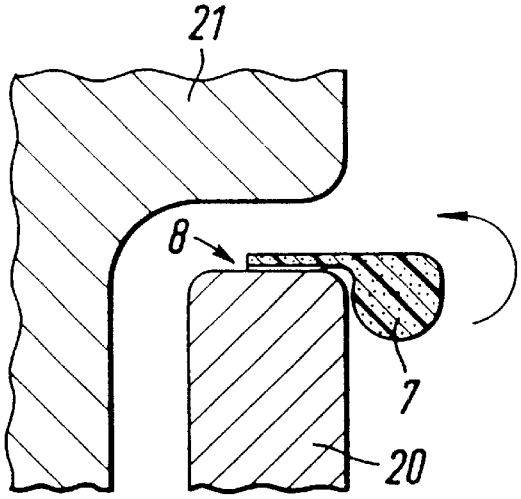
FIGS. 6(A) and (B) are cut-away views showing a further application of the sealing strip shown in FIG. 2.
Figure 6B:
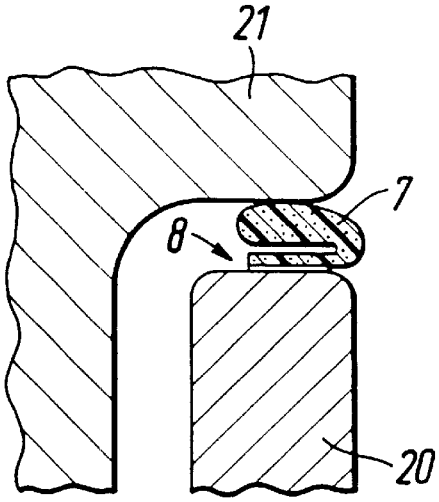

FIGS. 6(A) and (B) illustrate a further application of the sealing strip. In this case, the gap to be sealed is between two fixed components such as a vehicle bumper 20 and a front (or rear) body panel 21. The sealing strip is first attached to one component, eg the bumper 20, by means of the adhesive strip 8 with the sealing member 7 outermost and facing away from the gap to be sealed as shown in FIG. 6(A). The adhesive strip 8 is then folded longitudinally so that the sealing portion is folded back and can be pushed into the gap to be sealed as shown in FIG. 6(B). Conventional masking can then be attached to the sealing strip in a known manner. It will be appreciated that such a gap is difficult to seal with a conventional sealing strip as it would be necessary to push the sealing strip into position before it adheres to one of the components, whereas. in practice, the strip will tend to stick to a component as soon as the adhesive comes into contact with the component.

In all the applications described above, the sealing strip is removed from the body panel after the paint or other surface treatment has dried sufficiently.

FIGS. 4, 5 and 6 illustrate applications of the sealing strip shown in FIG. 2. If will be appreciated that the sealing strips shown in FIG. 1, FIG. 3 and in FIGS. 7(A) and 7(F) may also be used in these applications.

The sealing strip described herein may be made in a variety of sizes and materials depending upon the application. For sealing gaps in a vehicle body prior to painting, it has been found that the sealing portion 7 conveniently has a width (in the direction in which the attachment portion extends laterally therefrom) in the range 5 to 50 mm and the attachment portion 8 a width in the range 10 to 50 mm.

The sealing portion preferably has a thickness (in a direction normal to the adhesive surface 2) in the range 5 to 50 mm and the attachment portion preferably has a thickness in the range 0.1 to 30 mm.

The combined width of the sealing portion and attachment portion is preferably in the range 20 to 90 mm (so as to be wide enough to attach to a body panel and extend into a gap adjacent thereto which is to be sealed) and, as previously indicated, the sealing portion is preferably of greater thickness than the attachment portion. This is important for several reasons. Firstly, if the sealing portion and attachment portion are of different thickness, the sealing strip can be easily attached in the correct position around the edge of a panel by locating the edge of the panel in the step between the sealing portion and the attachment portion. Furthermore, the greaser thickness of the sealing portion causes it to project beyond the edge of the panel into the space which is to be sealed (as illustrated in FIGS. 4 and 5). The change in thickness between the sealing portion and the attachment portion also provides a natural longitudinal hinge to assist in folding the sealing portion back over the attachment portion in applications such as that described above in relation to FIG. 6.

In further embodiments of the invention (not shown), at least the sealing portion of the sealing strip may be hollow.

Figure 8:
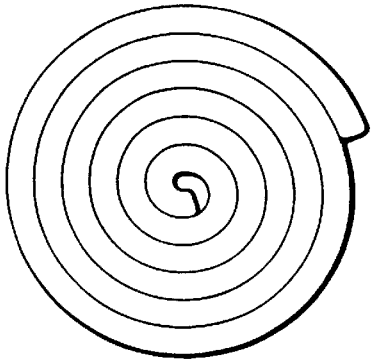
FIG. 8 shows a view of a sealing strip provided in roll form.

The sealing strip has substantially the same cross-section over its whole length and may be provided in any convenient length. Typically it may be provided in lengths of several meters in roll form (as illustrated in FIG. 8). The sealing portion 7 can be formed of any material having sufficient resilience to be able to conform to the shape of a gap in which it is installed and to press against and thus seal the sides of the gap. Possible materials include: polymeric foam, synthetic sponge and rubber.

The sealing strip may conveniently be manufactured by an extrusion process.

If the sealing strip is to be used to seal gaps adjacent to a panel being sprayed, as described above, it also needs to be made of a material which will not be affected by the paint (or other material being sprayed), although it may absorb the paint, and should preferably be useable in and withstand temperatures in the range 0° to 80° C. The material should also be lint free so that it does not spread any dust or particles on the paint surface even when compressed air, eg at up to 150 psi (1000 $KN/m^2$), is passed over it and the adhesive should be strong enough to withstand this pressure without the sealing strip lifting off the component. The sealing strip should also be sufficiently flexible to be able to follow the contours of the component to which it is fitted.

The attachment portion and the sealing portion may also be formed of a tacky material in which case it would not be necessary to provide a layer or strip of adhesive to provide the required adhesive surface(s).

As indicated above, in some applications, it may be found advantageous to provide one or more bands of adhesive along the sealing strip in addition to chat provided on the laterally extending attachment portion. A further band (of adhesive may, for example, be provided on the convex surface of the sealing portion which faces in the same direction as the adhesive layer on the laterally extending strip (as shown in FIG. 7(D)) or on the opposite surface of the sealing portion. An adhesive layer may also be provided on both faces of an attachment portion as shown in FIG. 7(F) which extends radially from the sealing member so that the sealing strip may be used either way round.

As well as acting to seal gaps at the edges of panels being sprayed, a sealing strip such as that described above can be used in place of hard line masking (such as masking tape) across the centre of a panel being sprayed. The sealing strip is attached to the panel by adhering the adhesive strip 8 to the panel so that the convex surface of the sealing portion 7 lies against the panel along the boundary of the area to be sprayed. The convex shape of the sealing portion 7 is such as to produce a "soft", indefinite edge to the resprayed area as some paint is able to penetrate the small space between the curved form of the sealing portion and the panel to which it is attached.

The sealing strip described above thus makes it easier to seal certain gaps, such as the "B" post gap, on a vehicle body and thus saves a considerable amount of time in the process of masking a vehicle body in preparation for spraying.

INDUSTRIAL APPLICABILITY

The sealing strip and method of sealing described above can be used in the sealing or masking of vehicle body panels during paint spraying or other spraying treatments and in a wide range of other applications.

What is claimed is:

1. A sealing strip adapted to seal a gap between a body of a motor vehicle and an edge of a body panel that has an inner surface and is moveable between open and closed positions relative to the body of the motor vehicle, said sealing strip comprising:

an elongate sealing portion of resiliently compressible material and an elongate attachment portion having at least a part extending laterally from the sealing portion, the sealing portion having a cross-section with a convex surface along a first side thereof and having an adhesive surface on the convex surface and/or on the opposite surface thereof, and the attachment portion having an adhesive surface on said part extending laterally from the sealing portion and facing in substantially the same direction as said convex surface of the sealing portion, the laterally extending part of the attachment portion having a substantially uniform thickness in a direction normal to said adhesive surface of said part; and the adhesive on the attachment portion adapted to adhere to the inner surface of the body panel with the sealing portion projecting beyond the edge of the body panel when the body panel is in the open position such that the sealing portion seals the gap between the edge of the body panel and the motor vehicle when the body panel is moved to the closed position, wherein a width of the attachment portion is in the range of 10 mm to 50 mm and/or a combined width of the sealing portion and the attachment portion is in the range of 20 mm to 90 mm, said widths being defined in a direction in which the attachment portion extends laterally, and wherein the sealing portion and the attachment portion are formed as a single integral piece.

2. A sealing strip of claim 1, wherein the attachment portion is substantially rectangular in cross section.

3. A sealing strip adapted to seal a gap between a body of a motor vehicle and an edge of a body panel that has an inner surface and is moveable between open and closed positions relative to the body of the motor vehicle, said sealing strip comprising:

an elongate sealing portion of resiliently compressible material;

an elongate attachment portion extending laterally from the sealing portion; and an adhesive surface on the attachment portion adapted to adhere to the inner surface of the body panel with the sealing portion projecting beyond the edge of the body panel when the body panel is in the open position such that the sealing portion seals the gap between the edge of the body panel and the body of the motor vehicle when the body panel is moved to the closed position, wherein the attachment portion has a substantially uniform thickness in a direction normal to said adhesive surface, and wherein a width of the attachment portion is in the range of 10 mm to 50 mm and/or a combined width of the sealing portion and the attachment portion is in the range of 20 mm to 90 mm, said widths being defined in a direction in which the attachment portion extends laterally, and wherein the sealing portion and the attachment portion are formed as a single integral piece.

4. The sealing strip of claim 3, wherein the attachment portion extends laterally from the sealing portion in a first direction and the sealing portion has a greater thickness in a direction substantially perpendicular to said first direction and said attachment portion.

5. The sealing strip of claim 3, wherein the attachment portion is substantially rectangular in cross section.

6. A sealing strip adapted to seal a gap between a body of a motor vehicle and an edge of a body panel that has an inner surface and is moveable between open and closed positions relative to the body of the motor vehicle, said sealing strip comprising:

an elongate sealing portion of resiliently compressible material and an elongate attachment portion having a part extending laterally from the sealing portion, the sealing portion having a cross-section with a convex surface along a first side thereof and having an adhesive surface on the convex surface and/or on the opposite surface thereof, and the attachment portion having an adhesive surface on said part extending laterally from the sealing portion and facing in substantially the same direction as said convex surface of the sealing portion, the laterally extending part of the attachment portion having a substantially uniform thickness in a direction normal to said adhesive surface of said part; and the adhesive on the attachment portion adapted to adhere to the inner surface of the body panel with the sealing portion projecting beyond the edge of the body panel when the body panel is in the open position such that the sealing portion seals the gap between the edge of the body panel and the motor vehicle when the body panel is moved to the closed position, wherein the sealing portion and attachment portion are formed as a single integral piece.

7. The sealing strip of claim 6, wherein the sealing portion is substantially circular or substantially oval in cross section.

8. The sealing strip of claim 6, wherein the attachment portion is substantially rectangular in cross section.

* * * * *

UNITED STATES PATENT AND TRADEMARK OFFICE

CERTIFICATE OF CORRECTION

PATENT NO. : 6,548,163 B1
DATED : April 15, 2003
INVENTOR(S) : Robin William Hills It is certified that error appears in the above-identified patent and that said Letters Patent is hereby corrected as shown below:

Title page, Item [54] and Column 1, lines 1-2,
Title, delete "AND METHOD OF SEALING".

Column 1,
Line 44, "caps" should read -- gaps --.

Column 3,
Line 4, "whether or paper" should read -- whether paper --.
Line 17, "so that is" should read -- so that it --.

Column 4,
Line 3, "way round" should read -- way around --.
Line 6, "Folded" should read -- folded --.
Line 40, "such as as" should read -- such as --.
Line 41, "It a" should read -- If a --.
Line 49, "2" should read -- 12 --.

Column 5,
Line 8, "portion" should read -- portion 7 --.
Line 21, "If" should read -- It --.
Line 47, "greaser" should read -- greater --.

Column 6,
Line 20, "Chat" should read -- that --.
Line 21, "(of" should read -- of --.
Line 29, "round" should read -- around --.

Signed and Sealed this

Eighteenth Day of November, 2003

JAMES E. ROGAN
*Director of the United States Patent and Trademark Office*